United States Patent [19]

Raymond

[11] 4,418,415

[45] Nov. 29, 1983

[54] CERAMIC FIBER INSULATED FURNACES WITH ELECTRICAL HANGER ELEMENT OF GREAT MECHANICAL INTEGRITY

[75] Inventor: Yvan G. Raymond, Niagara Falls, Canada

[73] Assignee: Kennecott Corporation, Cleveland, Ohio

[21] Appl. No.: 355,495

[22] Filed: Mar. 8, 1982

[51] Int. Cl.[3] ..... H05B 3/66

[52] U.S. Cl. ..... 373/130; 373/137; 219/531

[58] Field of Search ..... 373/130, 137, 128, 134; 338/315, 317, 318, 290, 280; 219/531, 343, 357, 355; D6/132; 248/235

[56] References Cited

U.S. PATENT DOCUMENTS

| | | | |
|---|---|---|---|
| 1,622,650 | 3/1927 | Keene . | |
| 1,767,172 | 6/1930 | Cope . | |
| 1,853,382 | 4/1932 | Smalley . | |
| 1,861,947 | 6/1932 | Woodson et al. . | |
| 2,591,723 | 4/1952 | Sampson | 72/14 |
| 3,987,237 | 10/1976 | Phillips | 373/130 |
| 4,011,394 | 3/1977 | Shelley | 373/137 |
| 4,088,825 | 5/1978 | Carr | 13/25 |
| 4,154,975 | 5/1979 | Sauder | 13/20 |
| 4,272,638 | 6/1981 | Cimochowski | 13/25 |

FOREIGN PATENT DOCUMENTS 1433744 4/1976 United Kingdom .

OTHER PUBLICATIONS

"Taki Hook Joint", Brochure of Taki Industries Co., Ltd., Nagoya, Japan.

*Primary Examiner*—Roy N. Envall, Jr.
*Attorney, Agent, or Firm*—David M. Ronyak; R. Lawrence Sahr

[57] ABSTRACT

This invention relates to an electrical element support system that utilizes a series of ceramic hanger elements of generally rectangular cross-section which are adapted to be inserted into a clip which is attached by welding or bolting to the furnace wall. The clip provides bearing surfaces which match surfaces on the hanger element to provide support for the electrical element which is carried at the end of the support. The outer end of the hanger element generally has a hook or other device which is adapted to hold a particular electrical heating element.

24 Claims, 9 Drawing Figures

CERAMIC FIBER INSULATED FURNACES WITH ELECTRICAL HANGER ELEMENT OF GREAT MECHANICAL INTEGRITY

TECHNICAL FIELD

The invention relates to systems for mounting electric heating elements for use in furnaces insulated with fibrous materials. It more particularly relates to systems for mounting support elements for electrical heating in the form of ribbons, wire conductors or bars in furnaces lined with ceramic fiber modules or ceramic fiber blankets.

BACKGROUND ART

With the increasing use of ceramic fiber insulation in order to conserve energy in electric furnaces, it has become apparent that there is a continuing need for reliable mounting systems for electric heating elements in furnaces insulated with ceramic fiber. There is a need for mounting systems which are suitable for use both with ceramic fiber modules and with ceramic fiber insulation in the form of blankets which are placed like wallpaper onto the furnace walls and held there with studs. There is a continuing problem with systems for holding electric hangers in furnaces insulated with ceramic fiber in that the hangers must possess strength to hold the electric heaters at high temperatures, but should not conduct significant heat to the shell of the furnace, should not distort the ceramic fibers or become dislodged during long-term use at high temperature and must not conduct electricity. The hangers further should be easily repairable. The problems with creation of reliable hangers for electrical elements are especially difficult at high temperatures such as above 1800° F.

It has been proposed in U.S. Pat. No. 4,088,825 to Carr, that hangers for insulating members be held in place by anchors inserted between adjacent ceramic fiber bats and formed of electrically insulating material. A difficulty with this system is that it relies on the ceramic fibers to provide the strength. The hangers may distort the fibers, thereby opening up areas for heat to reach the shell and, further, it is not suitable for wallpaper type blanket insulation system. Further, the system requires large ceramic pieces which are expensive and provide weight which is likely to distort the fiber.

It has been suggested in U.S. Pat. No. 4,272,638 to Cimochowski, that electrical heaters be held by ceramic members which are placed against the furnace side of modules and held there by ceramic studs attached to the furnace housing. This system is very complicated and expensive. Further, it is generally not satisfactory for modules. Also, the system is difficult to install and is relatively heavy leading to possible distortion of the fibers.

U.S. Pat. No. 4,154,975 to Sauder discloses a system wherein electrical elements are supported by hooks attached to rods embedded in modules. This system also is expensive as the supporting elements must be preformed into modules in the desired locations. It further relies on the fibers themselves for structural strength which may cause difficulty at high temperatures. The system is difficult to install leading to high labor costs. It further relies on metal alloy hangers which may creep at high temperatures.

Another system has been proposed by Taki Industries Co., Ltd. of Japan which is a stud system utilizing insulating ceramic pieces to provide electrical insulation and utilizing direct welding of stud supports for alloy studs to the furnace wall. This also is a complicated system and under heavy weights has a bending effect on the alloy studs which may distort the fiber, especially at high temperatures.

Therefore, there remains a need for a simple, strong system of great mechanical integrity at high temperatures, particularly at temperatures above 1800° F.

DISCLOSURE OF INVENTION

It is an object of this invention to overcome disadvantages of prior electrical heating systems for furnaces insulated with ceramic fiber.

It is another object of this invention to provide an electrical heating element mounting system of great mechanical integrity at high temperatures.

It is a further object of this invention to provide a system for mounting electrical heating elements in ceramic fiber insulated furnaces which is relatively inexpensive.

It is another object of this invention to provide an easy to install support system for electrical heaters in ceramic fiber insulated furnaces.

It is a further additional object of this invention to provide a mounting system for electrical heating elements in ceramic fiber insulated furnaces which has positive retention of the hanger elements.

These and other objects of the invention are generally accomplished by providing elongated ceramic support members one end of which is placed into clips fastened to the furnace shell and then the other end extending through the ceramic fiber lining to end in a hook. These support elements or hangers are in generally rectangular cross-section with greater depth than width to provide great strength in the downward direction.

The electrical element support system of the invention utilizes a series of ceramic hanger elements of generally rectangular cross-section which are adapted to be inserted into a clip which is attached by welding or bolting to the furnace wall. The clip provides bearing surfaces which match surfaces on the hanger element to provide support for the electrical element which is carried at the end of the support. The outer end of the hanger element generally has a hook or other device which is adapted to hold a particular electrical heating element.

The structure and application of the sustentation device and inventive electrically heated furnace insulated by ceramic fiber will be better understood when referred to the drawings described below.

MODES FOR CARRYING OUT THE INVENTION

The invention has several advantages over the prior art system. The support system of the invention provides great mechanical integrity as the ceramic hanger members are rigidly held in clips bolted or welded to the metal frame of the furnace. Further, the invention does not rely on metals which soften and creep at high temperatures of greater than 1800° F. to support the electrical elements. The metal clip is generally at the temperature of the outer shell of the furnace at which it has great strength even when formed of inexpensive material. The system of the invention is easy to install without highly skilled personnel. Further, the system of the invention provides easy replacement of any hanger elements which become broken. The system provides a positive retention of the hanger elements rather than relying on suspension in the fibrous material which may shrink or sag, particularly at high temperatures. Another advantage of the instant invention is that the system may be used with modules that are not of special construction whereas many systems require special modular construction when the ceramic fiber insulation modules are to be used with electric heaters. The use of specially constructed modules raises expense, and this is not necessary with this invention.

Figure 1:
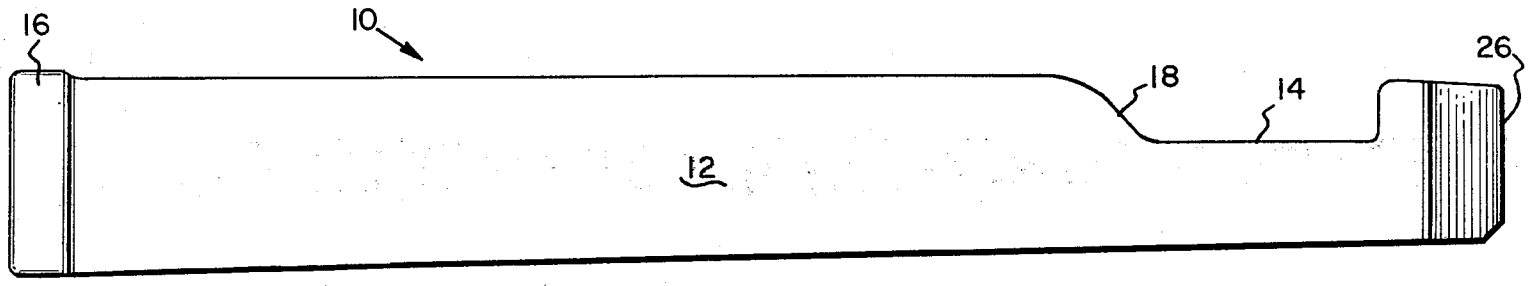
FIG. 1 represents the support device of the invention in side view.
Figure 2:
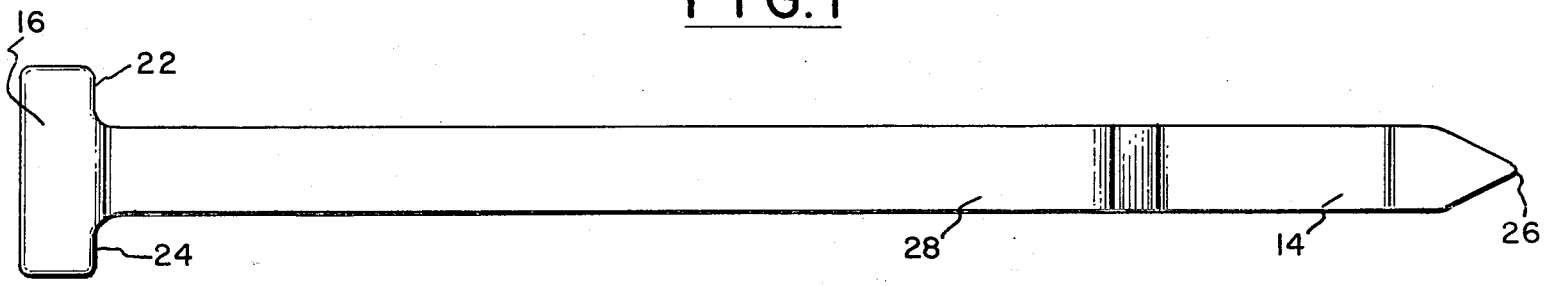
FIG. 2 represents a support device in accordance with the invention in top view.
Figure 3:
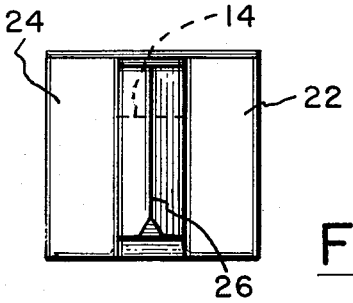
FIG. 3 represents an end view of the support device of the invention.

As illustrated in FIG. 1, the hanger element generally indicated as 10, comprises a hook portion 14, a body portion 12 and a retainer portion 16. The hanger, as illustrated in FIGS. 1–3, has the hook portion 14 comprising a gentle slope 18 which is less likely to lead to cracking than a sharp entry into the hook position and a pointed end 26 which aids in overlaying of the hanger elements with ceramic fiber blanket or modules. The depth of the body portion 12 is greater than its width at the top 28. This provides additional support to resist the downward weight of the heater on the hook portion 14 without deformation or breaking. The retainer portion 16 is composed of two bearing surfaces 22 and 24 which in use will bear against the clip retainers and provide mechanical integrity and strength to the hanger system.

Figure 4:
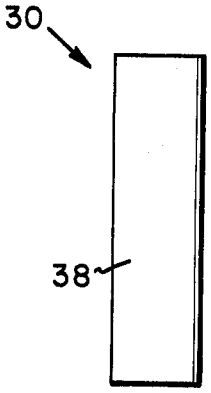
FIGS. 4, 5 and 6 represent side, top and end views of a clip adapted to hold the support device illustrated in FIGS. 1, 2 and 3.
Figure 5:
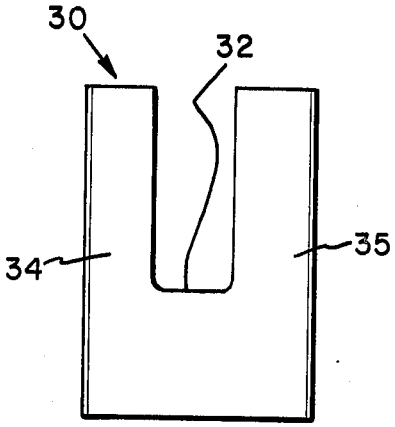
Figure 6:
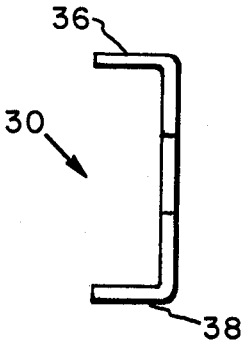

A clip suitable for the hanger of FIGS. 1, 2 and 3 is shown at FIGS. 4, 5 and 6 in front, side and top views. This clip generally is formed of a metal material, usually steel. The clip generally indicated as 30 is composed of the slot 32 in which the body of the ceramic hanger element 10 extends while the bearing surfaces 22 and 24 of the ceramic hanger element bear against surfaces 34 and 35 of the clip. The backward extending pieces 36 and 38 are of a depth of slightly more than the thickness of the retention portion 16 of the hanger 10 for easy insertion of the hanger element but relatively tight fit after insertion. The end portions of pieces 36 and 38 are generally welded to the frame of the furnace. In the alternative, it is possible that the device could be bolted or screwed into the furnace shell.

Figure 7:
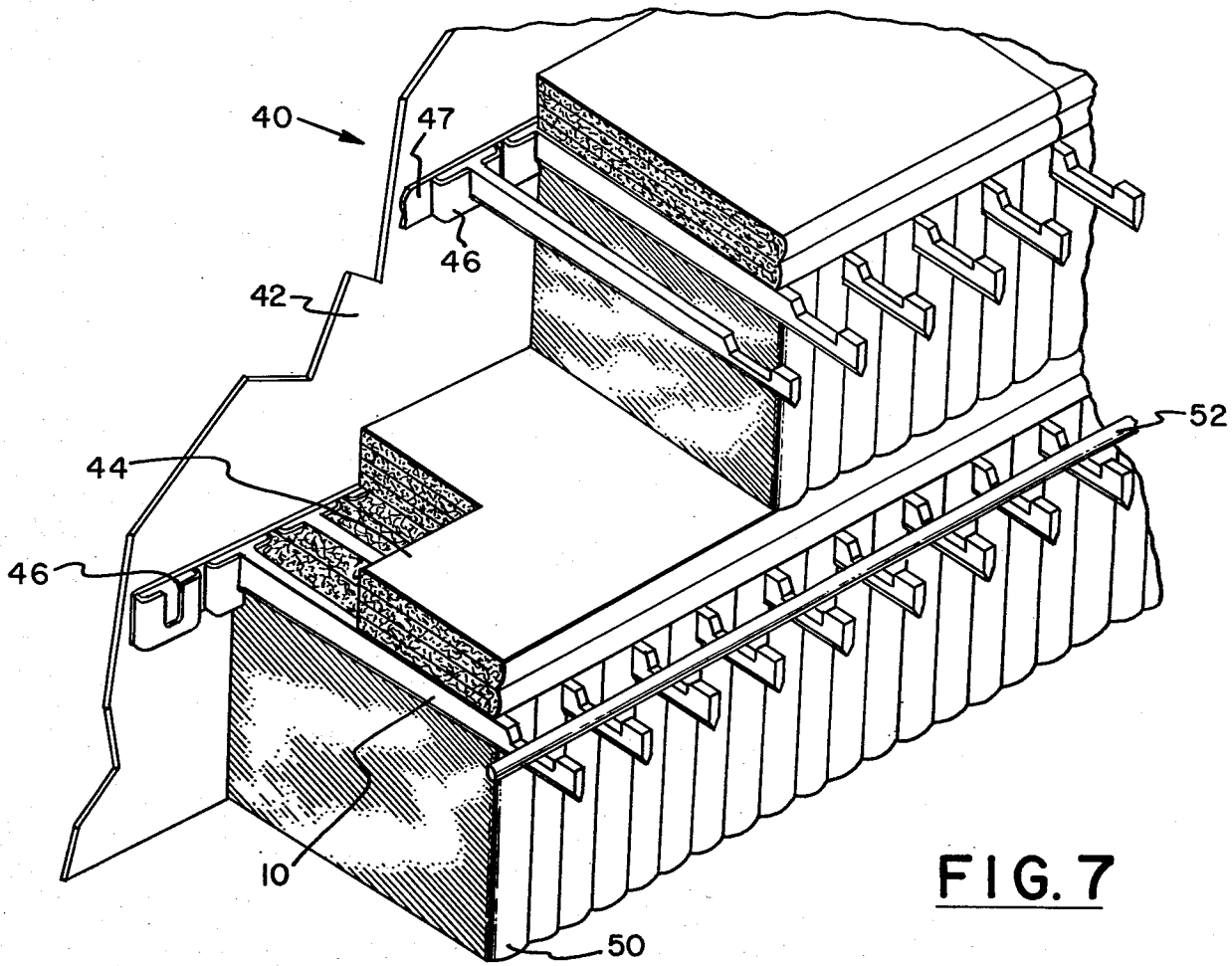
FIG. 7 is a perspective view of an electric furnace with a partially completed installation of the support system of the invention in a furnace to be insulated with modules.

Illustrated in FIG. 7, is the system of the invention utilized in a furnace insulated with modules, generally indicated as 40. The furnace 40 comprises a steel shell 42 which is being insulated with modules 50 and located between the modules are batten strips 44 of folded ceramic fiber. The hanger elements 10 are fastened in clips 46 and extend through the ceramic fiber. While illustrated with a rod heater 52, it is also within the invention to utilize ribbon heaters which would be wound in conventional zig-zag pattern up and down between the two levels of hangers. Coil heaters also could be used. As illustrated in the drawing, the hangers are supported by a series of clips 46 which have been pre-welded to support strips 47. Support strips 47 then are welded or bolted to the furnace shell 42 by means not shown. While illustrated with battens 44 between the modules, the furnace insulation also could be formed solely of modules without such batten strips. The ceramic fiber modules generally are held to the furnace wall by screwing or welding means, not shown. The backing plate to which the layers of fibers are attached in the modules and which is attached to the furnace wall generally does not cover the entire back of the module, usually leaving an inch or two on each side for compression of the modules during installation and to alleviate any possibility of interference between backing plates of adjacent modules during close fitting during installation. Therefore, the clips could easily fit between modules without the use of the batten strips 44 as are shown in this instance.

Figure 8:
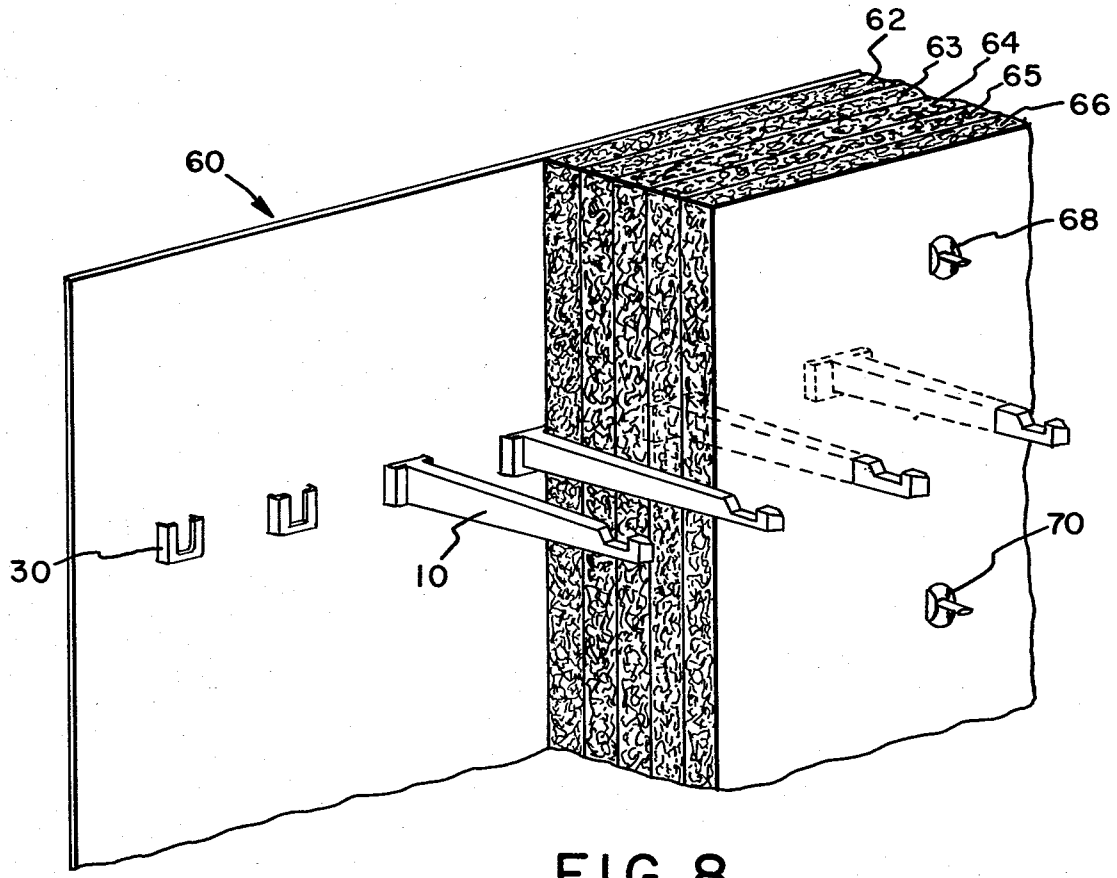
FIG. 8 is a perspective view of a furnace which is being insulated with blankets of fiber and in which the hanger system of the invention is being installed.

FIG. 8 illustrates the utilization of the hanger system of the invention in a furnace generally indicated as 60 insulated with blankets of ceramic fiber. The blankets of ceramic fiber 62, 63, 64, 65 and 66 are held in place by studs 68 and 70. The hanger elements 10 are in clips 30. The blankets are pierced during installation such that the hanger elements can extend through the blankets of ceramic fiber installation as do the studs 68 and 70 which hold the blanket in place.

The materials forming the hanging elements of the invention may be any material which is generally non-conductive and also temperature resistant at the intended temperature of the furnace. Typical of the materials suitable for the hanger elements of the invention are silicon carbide and alumina. These materials, while having very desirable temperature and strength properties, are expensive. Also suitable are electrical insulating porcelains composed of primarily alumina-silicate. The preferred materials for the system of the invention are mullite for applications up to about 2300° F., corderite for applications up to about 2000° F. and compositions composed of combination of mullite and corderite as these materials are easily formed, chemically stable and heat shock resistant.

The hangers of the invention may be any desired size that will extend through the ceramic fiber insulation. In one instance, a member for use with 8 inches of ceramic fiber had an overall length of about $11\frac{1}{2}$ inches and a height of the body portion of between 1 and $1\frac{1}{4}$ inches. The width being about $\frac{1}{2}$ inch. By the height, it is meant the body portion indicated as 12 in FIG. 1 and the width the portion indicated as 28 in FIG. 1. The retention element 16 was about $1\frac{1}{4}$ inches wide and the same $1\frac{1}{4}$ inches in height as the body. It is within the invention to form the hanger in any desired size which provides sufficient strength for the ceramic material used and under the temperature conditions contemplated. Generally, it is within the invention that the height of the hanger is more than twice its width for good mechanical integrity and strength. It is also within the invention to taper the hanger element such that the hook portion is not of as great height vertically as the portion back near the retention element. The portion for reception of the electrical element has been referred to as the hook although it could be any shape suitable for retention of electrical heating elements. The term "hook" as used herein is intended to include other heating element retention shapes.

While the hanger has been shown in rectangular cross-section, it is also within the invention that the cross-section could be oval or tear-shaped although this is generally considered to raise the cost of forming above that of rectangular cross-section without any increase in utility. Hangers of rectangular cross-section with rounded corners such as oval and egg-shaped are to be included by the term "generally rectangular".

Figure 9:
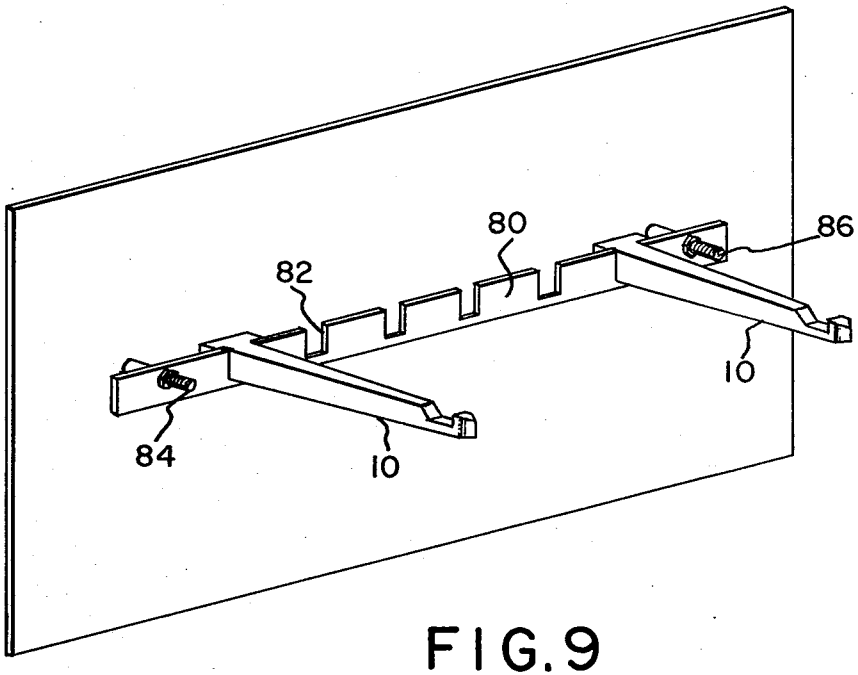
FIG. 9 is a perspective view of an alternate support system wherein one simple clip supports several hanger elements.

As illustrated in FIG. 9, there is an alternative arrangement of forming a retention system. In the system as illustrated in FIG. 9, the hangers 10 are held by plate 80 which has cutouts such as 82 in which the hanger elements 10 may be inserted. The plate 80 is bolted to the furnace by the threaded portion of studs 84 and 86 which are welded to the furnace wherever hangers are desired. It is within the invention to bolt the plate 80 to the furnace, rather than bolt it to welded studs as illustrated. The system of FIG. 9 allows the locations for a multitude of hanger elements to be placed with a minimum amount of welding.

Although described with reference to certain preferred embodiments, it would be clear to people skilled in the art that there are other variations in the hanger device in system of the invention which are obvious and intended to be included by the present specification and claims. The device could be formed with a larger retention surface or with a differently shaped bearing and retention surface. Further, when used with ribbon heating elements it would be obvious to mount the hanger elements with the hook facing downwardly in the lower row to retain the ribbon when it was passed under the hanger. Further, while the system has been illustrated with both modular and blanket systems of ceramic fiber insulation for furnaces, it also could be used with other mounting systems for ceramic insulation in furnaces or differing types of ceramic fiber modules.

What is claimed is:

1. A ceramic hanger for use in suspending or supporting electrical heating elements in a furnace having a wall, the hanger comprising a hook portion located at the outer end of the hanger connected by an elongate body portion of generally rectangular cross section to a retainer portion which extends substantially at right angles to the body portion for mounting the hanger, said retainer portion having bearing surfaces positioned substantially perpendicular to the lengthwise direction of the body portion which are adapted to engage a clip adapted to be mounted on a furnace wall.

2. A hanger according to claim 1 in which the body portion has a height which is greater than twice its width.

3. A hanger according to claim 2 in which the hook portion is pointed at its end directed away from the body portion.

4. A hanger according to claim 1 in which the edge of the hook portion towards the retainer portion is sloped up to the body portion at a gentle slope.

5. A hanger according to claim 1 wherein the body portion and the retainer portion together provide a T-shaped horizontal cross section.

6. A hanger according to claim 1 formed of a material selected from the group consisting essentially of mullite, corderite and mixtures thereof.

7. In combination, a ceramic hanger for use in suspending or supporting electrical heating elements in a furnace, the hanger comprising a hook portion located at the outer end of the hanger connected by an elongate body portion of generally rectangular cross section to a retainer portion which extends substantially at right angles to the body portion for mounting the hanger, and a clip adapted to be mounted on a furnace wall and engageable by the retainer portion of the hanger to support the hanger.

8. The combination according to claim 7 in which the clip comprises a supportive portion adapted to be mounted in spaced relationship to the furnace wall, the supportive portion being formed with a notch dimensioned to allow the body portion of a hanger to extend therethrough and locate the retainer portion of the hanger on one side of the supportive portion.

9. The combination according to claim 8 in which the one side of the supportive portion is provided with bearing surfaces engageable by bearing surfaces provided on the retainer portion of the ceramic hanger.

10. The combination according to claim 8 in which a plurality of supportive portions are provided by a plate adapted to be mounted on the furnace wall and formed with a plurality of spaced notches.

11. The combination according to claim 8 in which the supportive portion is formed with end pieces extending away from said one side thereof for mounting said supportive portion in spaced relationship to the furnace wall.

12. The combination according to claim 11 in which said supportive portion and end pieces provide a generally U-shaped configuration.

13. The combination according to claim 12 in which a plurality of clips are secured on a support strip in spaced relationship by said end pieces.

14. An electrically heated furnace having a furnace wall lined with ceramic fiber insulation and incorporating a plurality of hangers according to claim 1 mounted on said wall and extending through said ceramic fiber insulation and an electrical heating element supported on said hangers.

15. An electrically heated furnace having a furnace wall lined with ceramic fiber insulation and incorporating a plurality of ceramic hangers in combination with clips according to claim 7, the clips being mounted on the furnace wall and the hangers being supported on said clips and extending through said ceramic fiber insulation with an electrical heating element supported thereon.

16. A furnace according to claim 15 suitable for operation at temperatures greater than 982° C.

17. A method of installing an electric heating element in a furnace having a furnace wall comprising the steps of fastening a retention member onto the shell of the furnace; inserting a ceramic hanger into said retention member, said ceramic hanger element having a body portion of generally rectangular cross section extending from the furnace wall toward the furnace interior and terminating in a hook portion and having bearing surfaces adapted to fit in and bear against the retention member; affixing ceramic fiber insulation to the furnace wall at a thickness such that said hook portion of said hanger extends into the furnace interior beyond said ceramic fiber insulation and placing an electrical heating element onto the hook of said ceramic hanger.

18. The method of claim 17 in which said retention member is metal and is welded to said furnace shell.

19. The method of claim 17 in which said ceramic hanger element has a body portion having a height which is greater than twice its width.

20. The method of claim 17 in which the retention member is generally of U-shaped configuration and includes a generally rectangular notch receiving the body portion of the hanger.

21. The method of claim 17 in which said ceramic fiber insulation comprises modules.

22. The method of claim 17 in which said ceramic fiber insulation comprises blankets.

23. The method of claim 17 in which the electrical heating element is in the form of a rod, a coil or a ribbon.

24. Apparatus for suspension of electrical heating elements in a ceramic fiber insulated furnace including a wall comprising:

(a) a retention element adapted to be fastened to a furnace wall, the retention element including a supportive portion including a notch, the supportive portion being provided with bearing surfaces, the supportive portion including end pieces extending away from one side thereof for mounting the supportive portion in spaced relationship to the furnace wall; and (b) a ceramic hanger having an inner retainer portion adapted to engage said retention element, a hook portion located at its outer end connected by an elongate body portion of substantially rectangular cross section to the retainer portion which extends substantially at right angles to the body portion; said retainer portion including bearing surfaces positioned substantially perpendicular to the lengthwise direction of the body portion;

the notch of the supportive portion being dimensioned to allow the body portion of the hanger to extend therethrough and locate the retainer portion of the hanger on one side of the supportive portion with the bearing surfaces of the supportive portion bearing against those of the retainer portion.

* * * * *